US011795972B2

(12) United States Patent
Ichihara et al.

(10) Patent No.: US 11,795,972 B2
(45) Date of Patent: Oct. 24, 2023

(54) VACUUM PUMP AND VACUUM PUMP SYSTEM

(71) Applicant: Edwards Japan Limited, Yachiyo (JP)

(72) Inventors: Koichi Ichihara, Yachiyo (JP); Takashi Kabasawa, Yachiyo (JP)

(73) Assignee: Edwards Japan Limited, Yachiyo (JP)

( * ) Notice: Subject to any disclaimer, the term of this patent is extended or adjusted under 35 U.S.C. 154(b) by 0 days.

(21) Appl. No.: 17/640,149

(22) PCT Filed: Sep. 7, 2020

(86) PCT No.: PCT/JP2020/033757
§ 371 (c)(1),
(2) Date: Mar. 3, 2022

(87) PCT Pub. No.: WO2021/049454
PCT Pub. Date: Mar. 18, 2021

(65) Prior Publication Data

US 2022/0333612 A1 Oct. 20, 2022

(30) Foreign Application Priority Data

Sep. 12, 2019 (JP) ..... 2019-165839

(51) Int. Cl.
*F04D 29/58* (2006.01)
*F04D 19/04* (2006.01)
*F04D 27/00* (2006.01)

(52) U.S. Cl.
CPC ..... *F04D 29/584* (2013.01); *F04D 19/042* (2013.01); *F04D 27/006* (2013.01)

(58) Field of Classification Search
CPC ..... F04D 19/042; F04D 19/044; F04D 29/584
See application file for complete search history.

(56) References Cited

U.S. PATENT DOCUMENTS 5,252,036 A * 10/1993 Bunch ..... F25B 43/00 417/313
2002/0090309 A1* 7/2002 Yamashita ..... F04D 19/04 417/423.4

(Continued)

FOREIGN PATENT DOCUMENTS

JP H01247794 A 10/1989
JP 2006017089 A 1/2006

(Continued)

OTHER PUBLICATIONS

Kogame, Turbo Molecular Pump (Machine Translation)—'JP2013119798A_MT.pdf', Jun. 2013 (Year: 2013).*

(Continued)

*Primary Examiner* — Kenneth J Hansen
(74) *Attorney, Agent, or Firm* — Shumaker & Sieffert, P.A.

(57) ABSTRACT

A vacuum pump capable of removing side reaction products without overhaul is provided. The vacuum pump includes A motor for rotating a rotor, a heater capable of raising a temperature, a base spacer for holding the heater, a controller capable of controlling the heater by switching an operation mode between a normal operation mode and a cleaning operation mode, and a storage portion storing information on a set temperature relating to the heater, the storage portion stores at least first temperature information for the normal operation mode, or more specifically, set temperature information capable of using the pump without nonconformity, second temperature information for the cleaning operation mode, or more specifically, set temperature information capable of re-gasifying side reaction products generated during the normal operation mode, and the temperature represented by the second temperature information is (Continued)

higher than the temperature represented by the first temperature information.

7 Claims, 4 Drawing Sheets

(56) References Cited

U.S. PATENT DOCUMENTS

| | | | | |
|---|---|---|---|---|
| 2003/0129053 | A1* | 7/2003 | Nonaka | F04D 29/584 415/90 |
| 2009/0214348 | A1* | 8/2009 | Buccheri | F04D 19/042 29/889 |
| 2010/0247350 | A1* | 9/2010 | Nagano | F04D 29/5813 417/410.1 |
| 2018/0238334 | A1 | 8/2018 | Moriyama | |

FOREIGN PATENT DOCUMENTS

| | | | |
|---|---|---|---|
| JP | 2010138741 | A | 6/2010 |
| JP | 2013119798 | A | 6/2013 |
| JP | 2016167513 | A | 9/2016 |

OTHER PUBLICATIONS

International Search Report and Written Opinion of International Application No. PCT/JP2020/033757, dated Nov. 24, 2020, 9 pp.

* cited by examiner

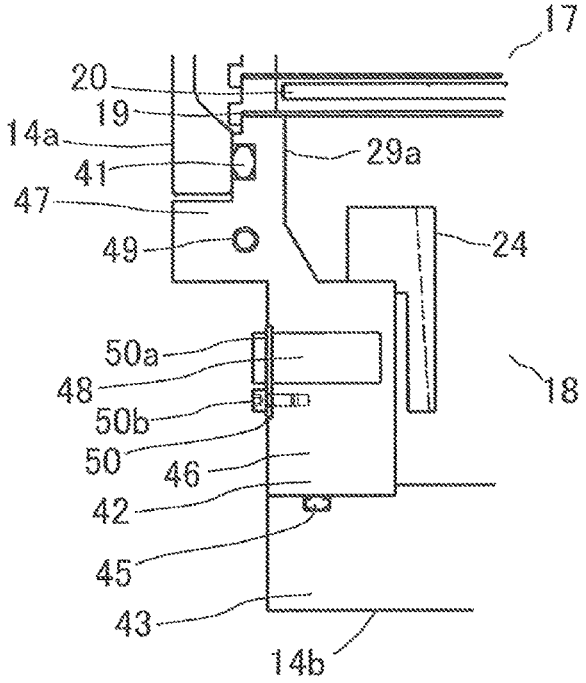
(a) Fig. 2A
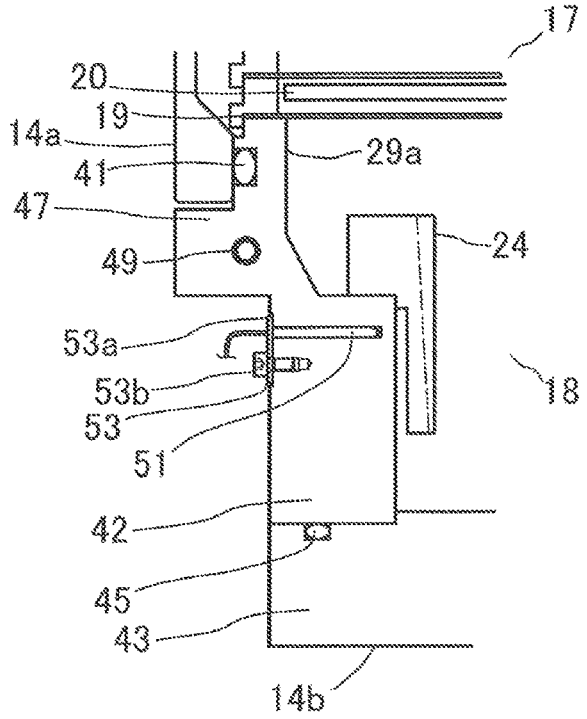
(b) Fig. 2B

VACUUM PUMP AND VACUUM PUMP SYSTEM

This application is a U.S. national phase application under 35 U.S.C. § 371 of international application number PCT/JP2020/033757 filed on Sep. 7, 2020, which claims the benefit of JP application number 2019-165839 filed on Sep. 12, 2019. The entire contents of each of international application number PCT/JP2020/033757 and JP application number 2019-165839 are incorporated herein by reference.

TECHNICAL FIELD

The present disclosure relates to a vacuum pump such as a turbo-molecular pump and the like, for example, and a vacuum pump system including a vacuum pump.

BACKGROUND

In general, a turbo-molecular pump is known as one type of a vacuum pump. In this turbo-molecular pump, a rotor blade is rotated by energizing a motor inside a pump main body, and a gas is exhausted by flipping gas molecules of a gas (process gas) sucked into the pump main body. Moreover, the turbo-molecular pump as above includes a type including a heater and a cooling pipe for properly controlling a temperature in the pump.

SUMMARY

In the vacuum pump such as the aforementioned turbo-molecular pump, substances in the gas to be transferred might be deposited in some cases. For example, in a process in which a gas used for an etching process of a semiconductor manufacturing device compresses the gas (process) sucked into a pump main body and gradually raises a pressure, side reaction products might be deposited inside the vacuum pump or a piping due to a condition under which a temperature in an exhaust passage falls under a sublimation temperature and blocks the exhaust passage. And the vacuum pump and the piping need to be cleaned in order to remove the deposited side reaction products. Moreover, depending on the circumstances, the vacuum pump and the piping might require repair or replacement with new products. And the semiconductor manufacturing device needs to be halted for these overhaul works in some cases. Furthermore, a period of the overhaul was prolonged to several weeks or more depending on the circumstances.

Moreover, some conventional vacuum pumps include a function of raising a temperature of the internal exhaust passage by a heater during an exhaust operation as a normal operation in order to prevent adhesion of the side reaction products to the inside. And at the heating as above, a limitation is set for the raised temperature (heating target temperature) in order to avoid swelling or deformation of constituent components of the vacuum pump caused by the heat and contact between the components, and temperature control is executed so that the temperature does not rise to a set temperature and above. And various ideas have been proposed so that the temperature is controlled to be not higher than an allowable temperature at which the pump can be used without nonconformity and can be heated to such a temperature that deposition of the side reaction products can be prevented. However, depending on a type of the side reaction product, there is a case where it is difficult to operate the vacuum pump under a temperature condition that can completely prevent deposition. In the end, the side reaction product is deposited, and the semiconductor manufacturing device is stopped so as to clean or repair the vacuum pump.

As described above, various ideas have been proposed for a temperature control method of the pump, but little attention has been paid to a method of efficiently cleaning or repairing the vacuum pump. An object of the present disclosure is to provide a vacuum pump in which a side reaction product can be removed without overhauling.

(1) In order to achieve the aforementioned object, the present disclosure is a vacuum pump including:

- a pump mechanism having a rotor;
- a casing enclosing the pump mechanism;
- a rotary drive means for rotating the rotor;
- a temperature raising means capable of raising a temperature;
- a temperature-raising holding means for holding the temperature raising means;
- a control means capable of controlling the temperature raising means by switching an operation mode between a normal operation mode and a cleaning operation mode; and
- a temperature-information storage means for storing information on a set temperature relating to the temperature raising means, wherein
- the temperature-information storage means stores at least first temperature information for the normal operation mode and second temperature information for the cleaning operation mode, and
- a temperature represented by the second temperature information is higher than the temperature represented by the first temperature information.

(2) Moreover, in order to achieve the aforementioned object, another disclosure is the vacuum pump described in (1), wherein

- the control means can control the rotary drive means by switching an operation mode between the normal operation mode and the cleaning operation mode, and includes a rotation-number information storage means for storing information on a set rotation number relating to the rotary drive means;
- the rotation-number information storage means stores at least first rotation-number information for the normal operation mode and second rotation-number information for the cleaning operation mode; and
- the rotation number represented by the second rotation-number information is lower than the rotation number represented by the first rotation number information.

(3) Moreover, in order to achieve the aforementioned object, another disclosure is the vacuum pump described in (1) or (2), having an exhaust-promotion gas introduction port which exhausts a processed gas generated in the cleaning operation mode.

(4) Moreover, in order to achieve the aforementioned object, another disclosure is the vacuum pump described in (3), wherein a purge port is also used as the exhaust-promotion gas introduction port.

(5) Moreover, in order to achieve the aforementioned object, another disclosure is the vacuum pump described in any one of (1) to (4), wherein the temperature raising means is at least either of a sheath heater and a cartridge heater.

(6) Moreover, in order to achieve the aforementioned object, another disclosure is the vacuum pump described in any one of (1) to (4), wherein the temperature raising means is an electromagnetic induction heater.

(7) Moreover, in order to achieve the aforementioned object, another disclosure is the vacuum pump described in any one of (1) to (4), wherein the temperature raising means is a planar heater.

(8) Moreover, in order to achieve the aforementioned object, another disclosure is the vacuum pump described in any one of (1) to (7), wherein a material for the temperature-raising holding means is at least any of an aluminum alloy, a stainless alloy, and a titanium alloy.

(9) Moreover, in order to achieve the aforementioned object, another disclosure is the vacuum pump described in any one of (1) to (8), wherein the rotor is used both in the normal operation mode and the cleaning operation mode.

(10) Moreover, in order to achieve the aforementioned object, another disclosure is the vacuum pump described in any one of (1) to (9), wherein a material for the rotor is at least either of an aluminum alloy and a stainless alloy.

(11) Moreover, in order to achieve the aforementioned object, another disclosure is a vacuum pump system including an auxiliary pump which assists exhaust of a processed gas generated in a cleaning operation mode, and the vacuum pump described in any one of (1) to (10).

According to the aforementioned disclosure, a vacuum pump in which a side reaction product can be removed without overhauling can be provided.

BRIEF DESCRIPTION OF THE DRAWINGS

FIG. 2A is an enlarged view illustrating a part of the turbo-molecular pump according to the example of the present.

FIG. 2B is an enlarged view illustrating another portion by changing a phase.

DETAILED DESCRIPTION

Figure 1:
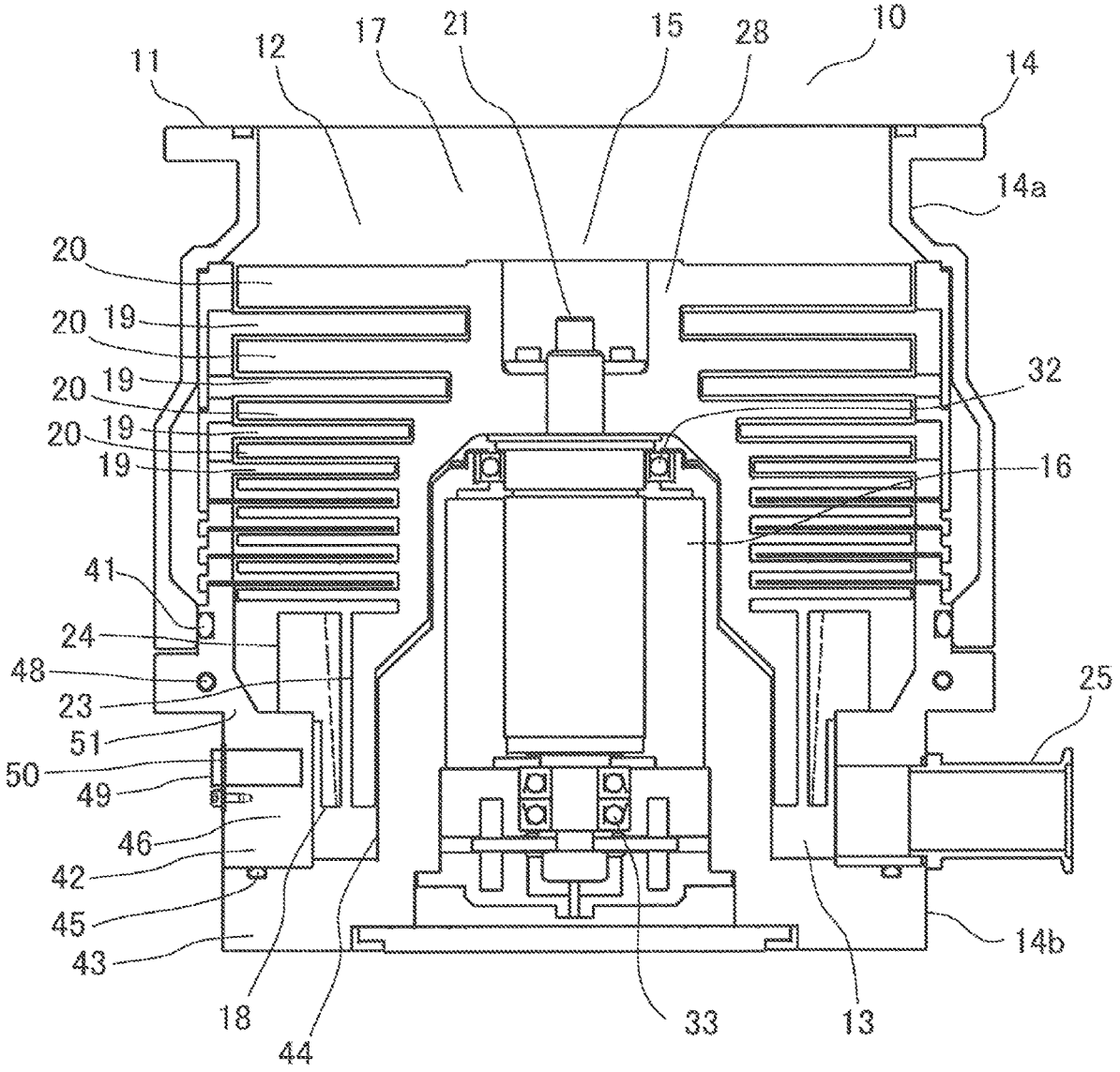
FIG. 1 is a cross sectional view of a turbo-molecular pump according to an example of the present disclosure.

Hereinafter, a vacuum pump according to each example of the present disclosure will be described on the basis of figures. FIG. 1 schematically illustrates a turbo-molecular pump 10 as a vacuum pump according to an example of the present disclosure by cutting it vertically. This turbo-molecular pump 10 is configured to be connected to a vacuum chamber (not shown) of a target device such as a semiconductor manufacturing device and the like, for example.

The turbo-molecular pump 10 integrally includes a cylindrical pump main body 11 and a box-shaped electric component case (not shown). In the pump main body 11 in them, an upper side in FIG. 1 is an inlet portion 12 connected to a side of the target device, and a lower side is an outlet portion 13 connected to an auxiliary pump (back pump) and the like. And the turbo-molecular pump 10 can be used with an inverted attitude, a horizontal attitude, and an inclined attitude other than a perpendicular attitude in a vertical direction as shown in FIG. 1.

The electric component case (not shown) accommodates a power-supply circuit portion (indicated by reference numeral 61 in FIG. 3) for supplying power to the pump main body 11 and a control circuit portion (indicated by reference numeral 62 in FIG. 3) for controlling the pump main body 11. And the control circuit portion 62 controls various devices such as a motor 16, a magnetic bearing (reference numeral omitted), a heater 48 and the like which will be described later, but a function of the control circuit portion 62 will be described later.

The pump main body 11 includes a main-body casing 14 which is a substantially cylindrical housing. The main-body casing 14 is constituted by an inlet-side casing 14*a* as an inlet-side component located on an upper part in FIG. 1 and an outlet-side casing 14*b* as an outlet-side component located on a lower side in FIG. 1 connected in series in an axial direction. Here, the inlet-side casing 14*a* can be referred to as a casing or the like, for example, and the outlet-side casing 14*b* as a base, for example.

The inlet-side casing 14*a* and the outlet-side casing 14*b* are stacked in a radial direction (left-right direction in FIG. 1). Moreover, the inlet-side casing 14*a* has an inner peripheral surface on one end portion in the axial direction (lower end portion in FIG. 1) opposed to an outer peripheral surface on an upper end portion 29*a* of the outlet-side casing 14*b*. And the inlet-side casing 14*a* and the outlet-side casing 14*b* are connected to each other in an air-tight manner by a plurality of bolts with hexagonal holes (not shown) with an O-ring (seal member 41) accommodated in a groove portion between them.

The outlet-side casing 14*b* has a structure roughly split into two parts, that is, a cylindrical base spacer 42 (vacuum-pump constituent component) and a base body 43 blocking the one end portion in the axial direction (lower end portion in FIG. 1) of the base spacer 42. Here, the base spacer 42 and the base body 43 can be also referred to as an upper base, a lower base or the like, respectively. Note that the base spacer 42 has a heating spacer portion 46 and a water-cooling spacer portion 47 which support the heater 48 and a water-cooling pipe 49 for TMS (Temperature Management System), but details of the base spacer 42 will be described later.

The pump main body 11 includes the substantially cylindrical main-body casing 14. In the main-body casing 14, an exhaust mechanism portion 15 and a rotary drive portion (hereinafter, referred to as a "motor") 16 are provided. Among them, the exhaust mechanism portion 15 is a composite type constituted by a turbo-molecular pump mechanism portion 17 as a pump mechanism and a screw-groove pump mechanism portion 18 as a screw-groove exhaust mechanism.

The turbo-molecular pump mechanism portion 17 and the screw-groove pump mechanism portion 18 are disposed so as to continue in the axial direction of the pump main body 11, and in FIG. 1, the turbo-molecular pump mechanism portion 17 is disposed on the upper side in FIG. 1, while the screw-groove pump mechanism portion 18 is disposed on the lower side in FIG. 1. Hereinafter, basic structures of the turbo-molecular pump mechanism portion 17 and the screw-groove pump mechanism portion 18 will be schematically explained.

The rotor 20 includes the shaft 21 and blades 22 fixed to an upper part of the shaft 21 and provided side by side concentrically with respect to an axis of the shaft 21. The blade 22 and a rotating body 28 which will be described later are joined integrally and constitute a substantially cylindrical rotor blade 29.

The turbo-molecular pump mechanism portion 17 disposed on the upper side in FIG. 1 is for transferring a gas by a large number of turbine blades and includes stator blades 19 having a predetermined inclination and curved surfaces and formed radially (hereinafter, referred to as "stator blades") and rotor blades 20 (hereinafter, referred to as "rotor blades"). In the turbo-molecular pump mechanism portion 17, the stator blades 19 and the rotor blades 20 are disposed so as to be alternately aligned over approximately 10 stages.

The stator blade 19 is integrally provided on the main-body casing 14, and the rotor blade 20 enters between the upper and lower stator blades 19. The rotor blade 20 is integrated with a cylindrical rotor 28, and the rotor 28 is concentrically fixed to a rotor shaft 21 so as to cover an outer side of the rotor shaft 21. With rotation of the rotor shaft 21, the rotor shaft 21 and the rotor 28 are rotated in the same direction.

Here, in the pump main body 11, an aluminum alloy is employed as a material for major components, and materials for the outlet-side casing 14*b*, the stator blade 19, the rotor 28 and the like are also an aluminum alloy. Moreover, in FIG. 1, in order to avoid complication of the figure, expression of hatching indicating a cross section of a component in the pump main body 11 is omitted.

The rotor shaft 21 is machined to a stepped columnar shape and reaches the screw-groove pump mechanism portion 18 on the lower side from the turbo-molecular pump mechanism portion 17. Moreover, at a center part in the axial direction in the rotor shaft 21, the motor 16 is disposed. This motor 16 will be described later.

The screw-groove pump mechanism portion 18 includes a rotor cylinder portion 23 and a screw stator 24. This screw stator 24 is also called an "outer screw", and an aluminum alloy is employed as the material for the screw stator 24. On a rear stage of the screw-groove pump mechanism portion 18, an outlet port 25 to be connected to an exhaust pipe is disposed, and an inside of the outlet port 25 and the screw-groove pump mechanism portion 18 are spatially connected. Here, as the screw-groove pump mechanism portion 18, a Holweck type drag pump constituting an exhaust mechanism by a drag effect of the rotor cylinder portion 23 can be employed, for example.

Moreover, in the turbo-molecular pump 10, it is configured such that a purge gas (protection gas) is supplied into the main-body casing 14. This purge gas is used for protecting a bearing portion which will be described later, the above-described rotor blade 20 and the like and performs prevention of erosion caused by the process gas, cooling of the rotor blade 20 and the like. This supply of the purge gas can be performed by an ordinary method.

For example, a purge-gas passage extending linearly in the radial direction is provided at a predetermined portion of the outlet-side casing 14*b* (a position separated by approximately 180 degrees with respect to the outlet port 25, for example), though not shown. And to this purge-gas passage (or more specifically, a purge port which is an inlet of the gas), the purge gas is supplied through a purge-gas bomb (N2 gas bomb or the like) or a flow-rate controller (valve device) and the like from an outside of the outlet-side casing 14*b*. And the purge gas having flown through the bearing portion and the like passes through the outlet port 25 and is exhausted to the outside of the main-body casing 14.

The aforementioned motor 16 has a rotor (reference numeral omitted) fixed to an outer periphery of the rotor shaft 21 and stators (reference numeral omitted) disposed so as to surround the rotor. Supply of power for operating the motor 16 is performed by the power-supply circuit portion (reference numeral 61 in FIG. 3) and the control circuit portion (reference numeral 62 in FIG. 3) accommodated in the aforementioned electric component case (not shown).

For supporting the rotor shaft 21, though detailed illustration or reference numerals are omitted, a non-contact type bearing by magnetic floating (magnetic bearing) is used. Thus, in the pump main body 11, such an environment is realized in which there is no abrasion in high-speed rotation, a life is long, and a lubricant is not needed. Note that, as the magnetic bearing, the one in which a radial magnetic bearing and a thrust bearing are combined can be employed.

Moreover, in peripheries of an upper part and a lower part of the rotor shaft 21, protective bearings 32 and 33 (also referred to as a "protective bearing", a "touchdown (T/D) bearing", a "backup bearing" and the like) in the radial direction are disposed at a predetermined interval. By means of these protective bearings 32 and 33, even in a case where a trouble in an electric system or a trouble such as atmospheric entry or the like should occur, for example, a position or an attitude of the rotor shaft 21 is not largely changed, and the rotor blade 20 or a peripheral portion thereof is not damaged.

During an operation of the turbo-molecular pump 10 having the structure as above, the aforementioned motor 16 is driven, and the rotor blade 20 is rotated. And with the rotation of the rotor blade 20, the gas is sucked from the inlet portion 12 illustrated on the upper side in FIG. 1, and the gas is transferred to a side of the screw-groove pump mechanism portion 18 while gas molecules are caused to collide against the stator blade 19 and the rotor blade 20. Moreover, the gas is compressed in the screw-groove pump mechanism portion 18, and the compressed gas enters the outlet port 25 from the outlet portion 13 and is exhausted from the pump main body 11 through the outlet port 25.

Note that the rotor shaft 21, the rotor blade 20 rotated integrally with the rotor shaft 21, the rotor cylinder portion 23, the rotor (reference numeral omitted) of the motor 16 and the like can be collectively called a "rotor portion" or a "rotation portion" or the like, for example.

Subsequently, a heating/cooling structure constituted by the aforementioned base spacer 42 and peripheral components thereof will be described. The base spacer 42 is, as shown in FIG. 1 and FIGS. 2A and 2B, combined concentrically with the aforementioned base body 43 and constitutes a portion on the outlet side of the main-body casing 14. The base body 43 has a stator column 44 in charge of support of the motor 16, the rotor shaft 21 and the like, and the base spacer 42 surrounds a periphery on a base end side of the stator column 44 at a predetermined interval in the radial direction.

The base spacer 42 has, as shown in FIG. 2A in a partially enlarged manner, the heating spacer portion 46 and the water-cooling spacer portion 47. The base spacer 42 is an integrally molded product formed by applying predetermined machining and treatment to an aluminum casting, and the heating spacer portion 46 and the water-cooling spacer portion 47 are integrated with each other. And the base spacer 42 is assembled to the base body 43 with the side of the heating spacer portion 46 faced and is connected to the base body 43 through a bolt with a hexagonal hole, not shown, with an O-ring (seal member 45) between them.

Here, the base spacer 42 and the base body 43 can be also integrally molded by aluminum casting or stainless. However, by having a separate component as in this example, a component outer shape becomes smaller, ease is increased in various points such as machining, control, transport, and handling in assembling and the like of the component, and related costs can be suppressed.

Subsequently, the heating spacer portion 46 is formed annularly as a whole and has a rectangular cross section.

Moreover, to the heating spacer portion 46, the aforementioned screw stator 24 is combined and fixed in a state where heat can be conducted.

To the heating spacer portion 46, the heater 48 as a temperature raising means for heating and a temperature sensor 51 as shown in FIG. 2B are attached. The heater 48 among them is of a cartridge type. This heater 48 is inserted into the heating spacer portion 46 from an outside and is fixed to the heating spacer portion 46 through a heater-attaching tool 50 having a plate member 50*a*, a bolt 50*b* with a hexagonal hole and the like. The heater 48 changes a heat generation amount by electricity control. And the heater 48 conducts the generated heat to the heating spacer portion 46 and raises a temperature of the heating spacer portion 46. Here, disposition of the heater 48 is considered so that the heater 48 gets closer to the screw stator 24 and can efficiently heat the screw stator 24.

Moreover, in this example, the number of the heaters 48 is two, and these heaters 48 are disposed at a substantially 180-degree interval on the heating spacer portion 46. However, this is not limiting, and the number of the heaters 48 can be increased/decreased. However, in a case where the number of the heaters 48 is increased to four, for example, and these heaters 48 are disposed at a 90-degree interval, more efficient heating can be realized.

The aforementioned temperature sensor 51 shown in FIG. 2B is inserted into the heating spacer portion 46 from the outside and fixed through a temperature-sensor attaching tool 53. The temperature-sensor attaching tool 53 has a structure similar to that of the aforementioned heater-attaching tool 50 and has a plate member 53*a*, a bolt 53*b* with a hexagonal hole and the like.

In this example, the number of the temperature sensors 51 is two, and these temperature sensors 51 are disposed at a substantially 180-degree interval on the heating spacer portion 46. And the temperature sensors 51 are disposed substantially at a center (substantially in the middle of the two heaters 48) of a phase according to the disposition of the heaters 48 and are aligned in one line in a peripheral direction at a 90-degree interval together with the heaters 48. Moreover, the temperature sensors 51 are disposed so as to get closer to the screw stator 24 as much as possible and can detect the temperature of the heating spacer portion 46 heated by the heater 48 at a position closer to the screw stator 24. Here, as the temperature sensor 51, various general types such as a thermistor or the like, for example, can be employed.

In the water-cooling spacer portion 47, a water-cooling pipe 49 which is a stainless pipe is embedded (cast) so as to extend along the peripheral direction. The water-cooling pipe 49 is disposed so as to get closer to a boundary portion 52. Cooling water is supplied into the water-cooling pipe 49 through a pipe joint, not shown, and the cooling water flows through the water-cooling pipe 49 and takes heat of the water-cooling spacer portion 47 and is led out to an outside of the main-body casing 14. By means of such circulation of the cooling water, the water-cooling spacer portion 47 is cooled. Moreover, though not shown, a flowrate of the cooling water in the water-cooling pipe 49 is configured to be controlled by opening/closing (ON/OFF) of an electromagnetic valve.

Figure 3:
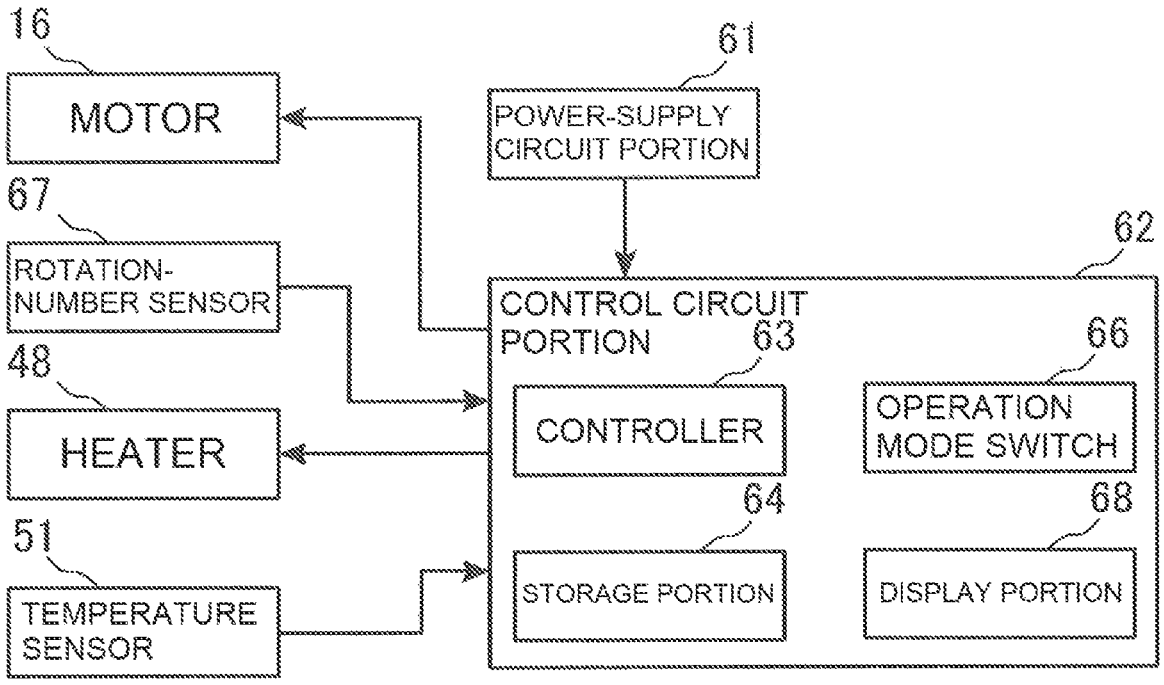
FIG. 3 is a block diagram schematically illustrating a configuration for control of the turbo-molecular pump according to the example of the present invention.

The aforementioned heater 48 is, as schematically shown in FIG. 3, controlled by a controller 63 of the control circuit portion 62. The control circuit portion 62 includes a storage portion 64 configured by a ROM, a RAM and the like. A part of or the whole of this storage portion 64 may be built in the controller 63.

The controller 63 has a CPU (Central Processing Unit) and is capable of executing temperature control of the heater 48 in accordance with a control program stored in the storage portion 64 by referring to various types of control data (which will be described later) similarly stored in the storage portion 64. Moreover, the controller 63 is also capable of controlling various devices such as the aforementioned motor 16, a magnetic bearing (numeral reference omitted) and the like. Furthermore, to the controller 63, a signal from the temperature sensor 51 is input. And the controller 63 can cause the motor 16 to be rotated at a predetermined rotation number and the temperature of the heater 48 to be raised to a predetermined temperature.

Moreover, into the controller 63, an operation signal of an operation mode switch (also referred to as a driving mode switch) 66 is input. This operation mode switch 66 is operated by a worker at switching between a normal operation mode (also referred to as a normal driving mode) and a cleaning operation mode (also referred to as a cleaning driving mode). As the operation mode switch 66, various general type switch devices can be used.

The aforementioned normal operation mode is, though details will be described later, an operation mode (operation state) in which a normal operation for keeping a target device (a semiconductor manufacturing device, here) to which the turbo-molecular pump 10 is connected at a predetermined vacuum degree or for transferring a gas of the target device (a process gas of the semiconductor manufacturing device, here). On the other hand, the cleaning operation mode is a non-normal operation mode in which a cleaning work for removing side reaction products deposited in the turbo-molecular pump 10 during driving in the normal operation mode is performed.

Regarding these operation modes, temperature information and rotation-number information according to the operation mode are stored in the aforementioned storage portion 64. Regarding the normal operation mode, first temperature information and first rotation-number information are stored in the storage portion 64. The first temperature information in them is information indicating a first temperature which is a temperature determined in advance so that a temperature environment of a passage of the gas becomes appropriate. Moreover, the first rotation-number information is information indicating a first rotation-number information determined in advance so as to be suitable for transfer of the gas.

Regarding the cleaning operation mode, second temperature information and second rotation-number information are stored in the storage portion 64. The second temperature information in them is information indicating a second temperature which is a temperature suitable for re-gasification of the side reaction products. The second temperature indicated by this second temperature information is a value higher than the first temperature according to the normal operation mode. Moreover, the second rotation-number information is information indicating a second rotation number which is a rotation number lower than the first rotation number according to the normal operation mode.

Subsequently, the operation of the turbo-molecular pump 10 in the normal operation mode and the cleaning operation mode will be described in more detail. First, in the normal operation mode, the turbo-molecular pump 10 receives the rotation-operation start signal which is an instruction signal from the controller 63 and rotates the motor 16. With the rotation of the motor 16, the rotor blade 20 is rotated, and exhaust and compression of the gas are started.

When the rotation number of the rotor blade 20 reaches the aforementioned first rotation number, adjustment of the rotation number of the rotor blade 20 is completed. When adjustment of the rotation number is to be completed, the rotation number of the rotor blade 20 is detected by a rotation-number sensor (reference numeral 67 in FIG. 3) disposed at a predetermined portion in the main-body casing 14. Moreover, a detection result of the rotation-number sensor 67 is input into the controller 63, and the controller 63 determines that the rotation number of the rotor blade 20 has reached the first rotation number and controls the motor 16 so that the rotation number is kept constant.

In parallel with the rotation-number control as above, heating temperature adjustment is conducted. In this heating temperature adjustment, the heater 48 is electrified, the temperature is raised, and portions in the periphery of the heater 48 are gradually heated. And when the temperature detected by the temperature sensor 51 reaches the aforementioned first temperature, the controller 63 determines that the temperature adjustment has been completed and controls the heater 48 so that the temperature is kept constant.

When the controller 63 determines that both the rotation number and the temperature have reached the respective target values (the first rotation number and the first temperature), it gives a notification that the turbo-molecular pump 10 has changed to a state of the normal operation (steady operation) through a display portion 68. And in the normal operation mode as above, the temperature in the passage of the gas is raised by the heater 48 to a certain degree and maintained, and deposition of the side reaction products is prevented within a range capable by the first temperature.

Moreover, the first temperature is a temperature determined so that excessive thermal expansion, deformation or the like is not caused in various constituent components (internal constituent components) to be heated and is an allowable temperature at which the pump can be used without nonconformity in the steady operation. Furthermore, the first temperature is determined by considering materials and strength of various internal constituent components and a flowrate and the like of the gas flowing into the turbo-molecular pump 10 from a vacuum chamber of the target device present in an upstream or the like.

And as described above, an aluminum alloy is employed as materials for the major internal constituent components such as the outlet-side casing 14*b*, the stator blade 19, the screw stator 24, the rotor 28, the base spacer 42 and the like, and moreover, in a case of a predetermined gas flowrate which is relatively common in experience as a precondition, the first temperature which is a temperature at the steady operation can be 100° C., for example.

However, the first temperature as above is only an allowable temperature at which the pump can be used without nonconformity, and the side reaction products could be deposited in some cases. If the side reaction product is ammonium fluoride, for example, since a sublimation temperature is 150° C., the side reaction product is deposited even if being maintained at 100° C. Thus, in this example, regarding the deposited side reaction products, gasification (re-gasification) in the cleaning operation mode is applied as described below so that the side reaction products can be removed.

In the cleaning operation mode, control is executed such that the heater 48 raises a temperature in peripheral portions thereof to the second temperature higher than the first temperature according to the normal operation mode in order to remove the side reaction products. The second temperature is a temperature which can re-gasify the side reaction products generated during the normal operation mode. In this example, the second temperature which is a temperature in the cleaning operation is set to 200° C. By conducting the re-generation by the gasification (re-gasification) as above, the side reaction products generated during the operation in the normal operation mode can be removed. Here, the gas generated by the re-gasification of the deposited side reaction products or the gas (process gas, here) from the target device (semiconductor manufacturing device, here) and the like can be collectively referred to as a "gas to be treated".

Moreover, in the cleaning operation mode, the motor 16 is controlled so as to be rotated at the second rotation number. This second rotation number is a rotation number of approximately 50% of the first rotation number. By driving the motor 16 at the second rotation number sufficiently lower than the first rotation number as above, as compared with the driving of the motor 16 at the first rotation number, compression heat or friction heat generated at exhaust of the gas can be reduced. Moreover, since a load of a centrifugal force or the like applied to the rotor blade 20 can be also reduced, the allowable temperature can be raised more than the case of the normal operation mode. On the other hand, the regenerated gas does not flow backward by a molecular transport force of the rotor blade 20 toward the stator blade 19 which is at a low temperature, since it is not heated by the heater 48, but is exhausted to an outside of the main-body casing 14 from the outlet port 25. And the exhaust of the re-gasified side reaction products is completed in a certain period of time from start of the rotation of the rotor blade 20. The "certain period of time" referred to here is determined by a condition of composition of the side reaction product and the like.

Figure 4:
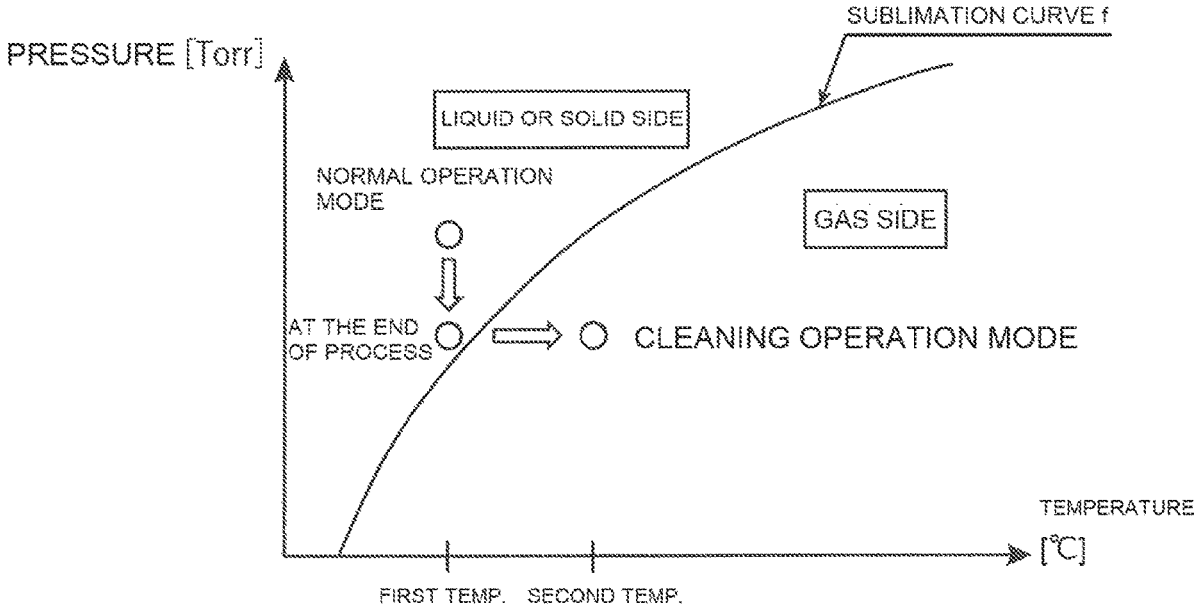
FIG. 4 is an explanatory view schematically illustrating a relationship between a normal operation mode and a cleaning operation mode by using a sublimation curve.

As described above, the rotor blade 20 is used also in the cleaning operation mode and transports the gas while being rotated at a speed lower than that of the normal operation mode and removes the gasified side reaction products efficiently and smoothly and thus, can prevent a pressure rise caused by collection of the gasified side reaction products. Therefore, by conducting the gasification at the second temperature and the gas exhaust at the second rotation number at the same time, the gasification of the side reaction products is promoted as compared with the case where only the gasification at the second temperature is conducted. Note that the gasification of the side reaction products can be expressed by a sublimation curve f (FIG. 4) in a phase diagram illustrating a relationship among a solid phase (solid), a liquid phase (liquid), and a gas phase (gas). And the side reaction products can be gasified in the gas phase region (gas side) of the sublimation curve f, but it is preferable that a temperature higher than the sublimation temperature is set in order to supply a heat amount required for the gasification. Moreover, in order to prevent backflow of the gasified side reaction products toward the stator blade 19, a port (exhaust-promotion gas introduction port) for introducing an exhaust promotion gas (N2 gas or the like) may be provided on the main-body casing 14 so as to sweep the side reaction products away. And the aforementioned purge port may be used also as this exhaust-promotion gas introduction port.

Moreover, transition from the normal operation mode to the cleaning operation mode can be conducted by a worker who operates the operation mode switch 66 described above during the normal operation mode so that the controller 63 controls the mode switching, for example.

Furthermore, to the contrary, transition from the cleaning operation mode to the normal operation mode can be also conducted by the worker who operates the mode switch 66 described above during the cleaning operation mode so that the controller 63 controls the mode switching, for example.

Here, it is preferable that, in the aforementioned "certain period of time" required for the exhaust of the regenerated gas, the operation mode switch 66 is disabled so as not to accept the operation of transition to the normal operation mode. And it can be configured such that the controller 63 determines whether the aforementioned "certain period of time" has elapsed or not, and if the time has elapsed, it accepts the operation of the operation mode switch 66. Moreover, such control can be executed that, if the aforementioned "certain period of time" has elapsed, the mode automatically changes to the normal operation mode without the operation of the operation mode switch 66.

Furthermore, it can be configured such that, in addition to the exhaust by the rotation of the rotor blade 20 during the cleaning, the regenerated gas is exhausted by an exhaust pump provided separately from the turbo-molecular pump 10. The exhaust during the cleaning using another exhaust pump as above can be referred to as an "exhaust assist", for example.

When this exhaust assist is to be performed, a back pump (not shown) as an auxiliary pump installed on a downstream side of the turbo-molecular pump 10 can be used. That is, in an exhaust system in which the turbo-molecular pump 10 is incorporated in general, the back pump (not shown) is provided on the downstream side from the turbo-molecular pump 10 in some cases. And by means of this back pump, in a first stage (first step) of the exhaust by the turbo-molecular pump 10, exhaust is performed at a vacuum degree lower than that of the turbo-molecular pump 10. Thus, the exhaust during the cleaning operation mode by using the back pump can be considered.

Furthermore, when the back pump as described above is used for the exhaust assist, the back pump is operated in the cleaning operation mode, and in a state where a predetermined degree of vacuum is acquired, the motor 16 of the turbo-molecular pump 10 is rotated (rotation start) so that the exhaust operation can be performed at the second rotation number. By performing such exhaust assist by the back pump as above, regenerated gas can be exhausted more efficiently.

Moreover, it can be also considered that the regenerated gas can be exhausted sufficiently by the exhaust by the back pump. In such a case, the control for rotary driving of the motor 16 does not have to be executed during the cleaning operation mode. In this case, power consumption of the turbo-molecular pump 10 in the cleaning can be reduced. However, by executing the control for rotary driving of the motor 16 as above at the same time, the gasification can be performed more reliably and rapidly.

Moreover, the rotation number of the motor 16 during the cleaning operation mode may be set to a rotation number (third rotation number) further lower than the second rotation. In this case, too, the power consumption of the turbo-molecular pump 10 in the cleaning can be reduced.

Furthermore, it can be considered to configure such that the exhaust assist can be performed regardless of presence/absence of the back pump. In this case, sales or the like of the turbo-molecular pump 10 can be conducted by combining a pump for the exhaust assist (exhaust-assist pump) as an additional device of the turbo-molecular pump 10, for example.

Note that, at the end of the cleaning operation mode, when the controller 63 determines that the temperature detected by the temperature sensor 51 has lowered to a predetermined temperature or below, such control can be executed that the display portion 68 displays that transition can be made to the normal operation mode, a predetermined LED is driven in a predetermined mode, or a predetermined sound is emitted or the like.

Moreover, if excessive heating is performed in the cleaning operation mode, a temperature in a clean room in which the turbo-molecular pump 10 or the target device (the semiconductor manufacturing device, here) is installed could be raised. Therefore, in order to prevent excessive heating, it can be considered that an output of the temperature sensor 51 is monitored also during the cleaning, and an output of the heater 48 is adjusted so that the second temperature is not exceeded. Moreover, in order to prevent excessive heating, such a measure can be taken that a temperature sensor for detecting a temperature environment is separately provided on an outer side of the main-body casing 14 or the like, and the cleaning is performed while a change in the temperature environment is monitored, for example.

Moreover, types of the side reaction products that can be deposited are different depending on the type of the gas to be used. If the type of the side reaction product is different, a value of the second temperature needs to be changed in some cases. Thus, it can be considered that information on the type of the gas to be used, the type of the side reaction product that could be generated, the second temperature suitable for the side reaction product and the like is collected in advance from a consumer (those concerned at a client or the like) of the turbo-molecular pump 10 so that an optimal second temperature for the consumer's use is determined when the second temperature is stored in the storage portion 64.

Furthermore, it can be considered to configure, after delivery of the turbo-molecular pump 10, the turbo-molecular pump 10 is used for a certain period of time and then, a worker can change the second set temperature. In this case, such use can be considered that, when the type of the gas used at the beginning of the start of use of the turbo-molecular pump 10 is to be changed to another gas after that, the worker changes the second temperature in accordance with the type of gas to be newly used, for example. Moreover, in order to enable change of the second temperature, a relationship between the types of gas and a plurality of second temperatures corresponding to them may be made into a table and stored in the storage portion 64.

According to the turbo-molecular pump 10 as described above, even if side reaction products are deposited and accumulated in the normal operation mode, the side reaction products can be removed by driving in the cleaning operation mode. Therefore, overhaul which stops the target device can be made unnecessary or a frequency of overhaul can be reduced. And an influence by the side reaction product on the operation of the target device can be minimized, and contribution can be made to improvement of production efficiency of semiconductors, for example.

Moreover, in the cleaning operation mode, not only that heating is performed but also that the motor 16 is being driven at the second rotation number which is a relatively low speed. Thus, by using the rotor 28 used in the normal operation mode also in the cleaning operation mode so as to rotate the rotor blade 20, the gas generated by the cleaning (regenerated gas) can be efficiently exhausted. And gasification can be promoted by this exhaust, and the cleaning can be advanced more efficiently.

Furthermore, since the regenerated gas can be exhausted efficiently, waiting time for exhaust of the regenerated gas can be kept short for the target devices such as the semiconductor manufacturing device and the like. As a result, improvement of production efficiency of the semiconductors or the like can be expected.

Moreover, by optimizing selection of a heater and by applying a heater with more efficient heating, temperature-rise time required for gasification of the side reaction product can be shortened. Thus, waiting time for the temperature rise can be kept short for the target devices such as the semiconductor manufacturing device and the like. As a result, improvement of production efficiency of the semiconductors or the like can be expected.

Moreover, in this example, a cartridge type is used for the heater 48. This cartridge-type heater (cartridge heater) is generally used as a heater for temperature control in the turbo-molecular pump in many cases. Therefore, by using the cartridge-type heater 48, most parts of the existing turbo-molecular pump can be utilized in terms of mechanical structures, and heating for cleaning can be performed without a drastic design change.

Here, in the turbo-molecular pump in general, a sheath heater is also used in many cases other than the cartridge heaters. Regarding the turbo-molecular pump using this sheath heater, too, the heating can be similarly performed for cleaning without a drastic design change.

Furthermore, instead of the cartridge heater or the sheath heater, various other general heaters can be applied. The various general heaters include an IH heater as an electromagnetic induction heater as an example. If the IH heater is used, for example, a predetermined temperature can be reached in a relatively short time, and time required for re-gasification and cleaning can be further shortened.

Moreover, when a planar heater is employed, temperature distribution can be uniformized, and even (uniform) heating or re-gasification can be performed in a wide range. And partial remaining of the side reaction products can be prevented and as a result, a frequency of overhaul and the like can be reduced. Moreover, production efficiency of the semiconductors and the like can be improved, and costs required for the overhaul and the like can be reduced.

Moreover, in this example, since a material with high heat conductivity or intensity against heat (heat intensity) such as aluminum (aluminum alloy) is employed as a material for the temperature-raising holding means (the base spacer 42 having the heating spacer portion 46, here) which holds the heater, efficient temperature rise and re-gasification can be realized.

Moreover, since the exhaust can be performed by the rotor blade 20 both in the normal operation mode and the cleaning operation mode, the rotor blade 20 can be shared in the both operation modes. Therefore, it is not indispensable to separately provide an exhaust mechanism for cleaning, and exhaust for cleaning can be performed with a low cost.

Furthermore, by selecting the constituent components of the turbo-molecular pump 10 so that gasification of the side reaction products composed of a high-temperature sublimable substance is enabled, the temperature that can be handled by the turbo-molecular pump 10 becomes higher than the conventional. And such a situation can be increased that, even if a process of the semiconductor manufacturing device is changed in the middle, and the type of a gas in use is changed, for example, the turbo-molecular pump 10 does not have to be replaced. As a result, costs related to the turbo-molecular pump can be reduced.

As combinations of constituent components of the turbo-molecular pump 10 and materials therefor, other than the rotor blade 20 made of an aluminum alloy, the rotor blade 20 can be constituted of a stainless alloy, for example. Moreover, the components other than the rotor blade 20 can be constituted of a stainless alloy. Furthermore, it can be configured such that an aluminum alloy is used for the material for the constituent components strongly requiring characteristics such as high heat conductivity, light weight, easy machinability and the like, while a stainless alloy is used for the material for the constituent components strongly requiring characteristics such as high rigidity, strength and the like, for example. Moreover, a titanium alloy can be also employed, for example, other than the aluminum alloy and the stainless alloy.

Note that the present disclosure is not limited to the aforementioned example but is capable of variations in various ways within a range not departing from the gist. For example, in the aforementioned example, the heater 48 and the temperature sensor 51 are provided in the heating spacer portion 46. However, this is not limiting, and the heater 48 and the temperature sensor 51 can be provided not only on the heating spacer portion 46 but also on the water-cooling spacer portion 47 or a portion other than the base spacer 42.

What is claimed is:

1. A vacuum pump comprising:

a pump mechanism having a rotor;

a casing enclosing the pump mechanism;

a rotary drive means for rotating the rotor;

a temperature raising means configured to raise a temperature;

a temperature-raising holding means for holding the temperature raising means;

a control means configured to control the temperature raising means by switching an operation mode between a normal operation mode and a cleaning operation mode; and a temperature-information storage means for storing information on a set temperature relating to the temperature raising means, wherein:

the temperature-information storage means stores at least first temperature information for the normal operation mode and second temperature information for the cleaning operation mode, a temperature represented by the second temperature information is higher than the temperature represented by the first temperature information, the control means is configured to control the rotary drive means by switching an operation mode between the normal operation mode and the cleaning operation mode, and includes a rotation-number information storage means for storing information on a set rotation number relating to the rotary drive means;

the rotation-number information storage means stores at least first rotation-number information for the normal operation mode and second rotation-number information for the cleaning operation mode; and the rotation number represented by the second rotation-number information is lower than the rotation number represented by the first rotation number information.

2. The vacuum pump according to claim 1, wherein the temperature raising means is at least either of a sheath heater and a cartridge heater.

3. The vacuum pump according to claim 1, wherein the temperature raising means is an electromagnetic induction heater.

4. The vacuum pump according to claim 1, wherein a material for the temperature-raising holding means is at least any of an aluminum alloy, a stainless alloy, and a titanium alloy.

5. The vacuum pump according to claim 1, wherein the rotor is used both in the normal operation mode and the cleaning operation mode.

6. The vacuum pump according to claim 1, wherein a material for the rotor is at least either of an aluminum alloy and a stainless alloy.

7. A vacuum pump system, comprising:

an auxiliary pump which assists exhaust of a processed gas generated in a cleaning operation mode, and a vacuum pump comprising a pump mechanism having a rotor;

a casing enclosing the pump mechanism;

a rotary drive means for rotating the rotor;

a temperature raising means configured to raise a temperature;

a temperature-raising holding means for holding the temperature raising means;

a control means configured to control the temperature raising means by switching an operation mode between a normal operation mode and the cleaning operation mode; and a temperature-information storage means for storing information on a set temperature relating to the temperature raising means, wherein:

the temperature-information storage means stores at least first temperature information for the normal operation mode and second temperature information for the cleaning operation mode, a temperature represented by the second temperature information is higher than the temperature represented by the first temperature information, the control means is configured to control the rotary drive means by switching an operation mode between the normal operation mode and the cleaning operation mode, and includes a rotation-number information storage means for storing information on a set rotation number relating to the rotary drive means;

the rotation-number information storage means stores at least first rotation-number information for the normal operation mode and second rotation-number information for the cleaning operation mode; and the rotation number represented by the second rotation-number information is lower than the rotation number represented by the first rotation number information.

* * * * *